US012752892B2

(12) United States Patent
Shiue

(10) Patent No.: US 12,752,892 B2
(45) Date of Patent: Oct. 6, 2026

(54) BREATHABLE MASK

(71) Applicant: QBAS Co., Ltd., Taipei City (TW)

(72) Inventor: Chih-Cheng Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 629 days.

(21) Appl. No.: 18/342,280

(22) Filed: Jun. 27, 2023

(65) Prior Publication Data

US 2023/0415867 A1 Dec. 28, 2023

Related U.S. Application Data

(60) Provisional application No. 63/356,230, filed on Jun. 28, 2022.

(30) Foreign Application Priority Data

Dec. 16, 2022 (TW) ..... 111148388

(51) Int. Cl.
*B63C 11/16* (2006.01)
*B63C 11/12* (2006.01)

(52) U.S. Cl.
CPC ..... *B63C 11/16* (2013.01); *B63C 2011/128* (2013.01); *B63C 2011/165* (2013.01)

(58) Field of Classification Search
CPC . B63C 11/12–16; B63C 2011/121–128; B63C 2011/165
See application file for complete search history.

(56) References Cited

U.S. PATENT DOCUMENTS

| | | | | |
|---|---|---|---|---|
| 10,556,654 | B2 | 2/2020 | Cucchia | |
| 10,793,239 | B2 | 10/2020 | Caprice et al. | |
| 2016/0297505 | A1 | 10/2016 | Caprice et al. | |
| 2018/0319471 | A1 | 11/2018 | Thomas | |
| 2019/0023366 | A1 | 1/2019 | Liao | |
| 2019/0225311 | A1* | 7/2019 | Barone | B63C 11/16 |
| 2020/0156745 | A1* | 5/2020 | Shiue | B63C 11/205 |
| 2020/0216157 | A1 | 7/2020 | Xiao | |

FOREIGN PATENT DOCUMENTS

| | | | |
|---|---|---|---|
| CN | 208412071 | U | 1/2019 |
| EP | 3 517 423 | A1 | 7/2019 |
| TW | 202112610 | A | 4/2021 |

* cited by examiner

*Primary Examiner* — Elliot S Ruddie
(74) *Attorney, Agent, or Firm* — MUNCY, GEISSLER, OLDS & LOWE, P.C.

(57) ABSTRACT

A breathable mask comprises a body and a breathing tube. The breathing tube is in fluid communication with an interior of the body. The body comprises a main frame, a lens module, and a waterproof sealing skirt. The lens module has a lens portion and a support device. The support device is integrally formed with the lens portion at a distance inward from an outermost edge of the lens portion, and is interconnected with a portion of the waterproof skirt to improve the rigidity of the vicinity of the portion.

14 Claims, 15 Drawing Sheets

BREATHABLE MASK

FIELD OF THE INVENTION

The present invention is a full-face mask, particularly a breathable mask for snorkeling.

DESCRIPTIONS OF THE RELATED ART

In order to allow mouth and nose to breathe freely, and let the user be able to inhale clean air as much as possible, and the exhaled dirty air not to be mixed with clean air as far as possible before the next inhalation cycle, most of the current full face masks (so-called Full Face Snorkel Mask, FFSM) divide the mask body into an upper chamber that covers the eyes and a lower chamber that covers the mouth and nose, so that the inhaled clean air can pass through the upper chamber unidirectionally, whereas part of the dirty air exhaled can be discharged through the drain valve in the lower chamber, and the other part is discharged through independent exhaust passages. The above-mentioned exhaust passages are all independently installed on the periphery of the upper chamber and communicated with the breathing tube, so that the discharged air can directly go to the outside through the breathing tube, and will not stay in the upper chamber to be inhaled again to enter the lower chamber. Such an air shunt structure of intake and exhaust looks feasible, but it is obviously insufficient in terms of product cost and reliability.

First of all, in terms of air intake from the upper chamber to the lower chamber, an intake one-way valve needs to be provided. The intake one-way valve is mostly in the form of a mushroom (that is construed by a hard circular wheel spoke valve seat, and a soft circular diaphragm), installed on the soft partition used to separate the upper chamber and the lower chamber. When the user wears the mask, the partition will be squeezed by users with different face shapes, or by wearing it too tightly or being pulled. That makes the partition be deformed, causing the intake one-way valve to be not in the correct position and therefore resulting in air leakage, or makes the intake one-way valve to operate incorrectly. If the user wears to fit the mask too loose, there will be no such problems, however, it adversely brings in another problem of water leaking in. Moreover, with such a structure, there are many parts and complicated procedures to be required in assembling the product.

In addition, in terms of exhaust, if the exhaust passage is made of soft material, it is convenient to form together with the waterproof sealing skirt, however, when in use, the soft passage is often pulled by different users (especially when it fits too tight), that may make the exhaust passage be unexpectedly blocked. Aging and deformation of the soft skirt during use after a long time will cause the same problem. Therefore, currently, most of the exhaust passages are mainly composed of a hard main frame, a lens portion, or both. Nevertheless, such a structure will eventually be required to assemble with the soft waterproof sealing skirt, the cost is increased and the waterproofness among parts is difficult to effectively control. In addition, the hard exhaust passage is easily broken when it is hit, and the reliability of the product is considered insufficient. U.S. Pat. No. 10,793,239B2 can be referred to for the disadvantages of using soft exhaust passages; whereas U.S. Pat. No. 10,556,654B2 can be referred to for the disadvantages of using the main frame as a hard exhaust passage.

In view of this, it is a common goal of the industry to simultaneously or partially solve the above-mentioned problems, make the intake and exhaust operations smooth, and effectively control the manufacturing and assembly costs.

SUMMARY OF THE INVENTION

The primary objective of the present invention is to provide a breathable mask, in which a support device is integrally provided on an appropriate area of the hard lens portion. When assembled, the support device can strengthen the rigidity of the soft functional components, such as the one-way air intake valve, the exhaust passage(s), or both, so that they can be operated more precise and reliable. In this way, these functional components can still be made of soft waterproof materials (such as silicone rubber) having lower cost and less complicated structure, or even can be made together with at the same time when the silicone rubber waterproof sealing skirt is in the molding process, which greatly reduces the manufacturing and assembly costs. More specifically, since the hard lens portion and the soft waterproof sealing skirt need to be assembled together, the present invention contemplates integrally adding some strengthening members to the lens portion, and these strengthening members can be additionally required elements (such as then retaining wall to support the soft exhaust passage, or the rigid rib(s) to stabilize the structure of the one-way valve), or can be an element that is already required (such as the hard seat of the one-way valve). This way, when the lens portion is assembled with the waterproof sealing skirt, there is no longer need to add additional parts, and the cost is greatly reduced, also driving the assembly to be much more convenient, and no doubt strengthening the product.

According to the above objective, the present invention specifically provides A breathable mask, comprising a body and a breathing tube, in which the breathing tube is in fluid communication with an interior of the body. The body includes a main frame, a lens module fitted in the main frame, and a waterproof sealing skirt, at least partially fitted with the main frame and the lens module. The waterproof sealing skirt is suitable for fitting on a user's face. The mask is featured in that the lens module has a lens portion and a support device, in which the support device is integrally formed with the lens portion at a distance inward from an outermost edge of the lens portion, and is connected to a portion of the waterproof sealing skirt, so as to increase rigidity of a vicinity of the portion the waterproof sealing skirt. Furthermore, the support device may be a hard valve seat of the one-way intake valve, a reinforcing rib in the vicinity of the one-way intake valve, and/or a retaining wall supporting the exhaust passage.

The secondary objective of the present invention is to provide a lens module having the above-mentioned support device, which is used in a breathable mask, in which the lens portion of the mask can be the style only covering the user's eyes, or the style covering user's eyes, nose, and mouth.

DESCRIPTION OF THE PREFERRED EMBODIMENT

Figure 1A:
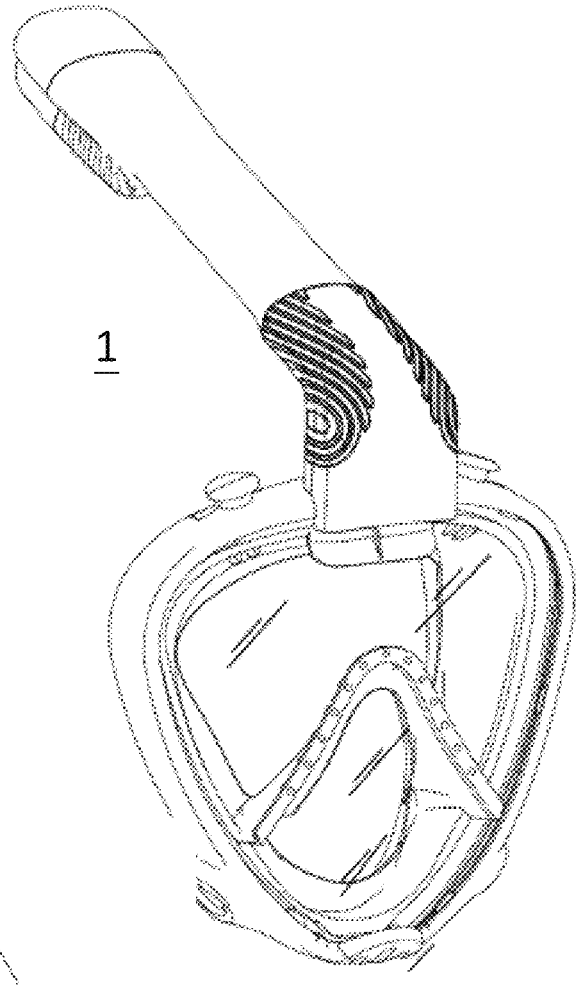
Fig. 1A (Prior art)
FIG. 1A is a schematic view of a traditional full-face snorkel mask.
Figure 1B:
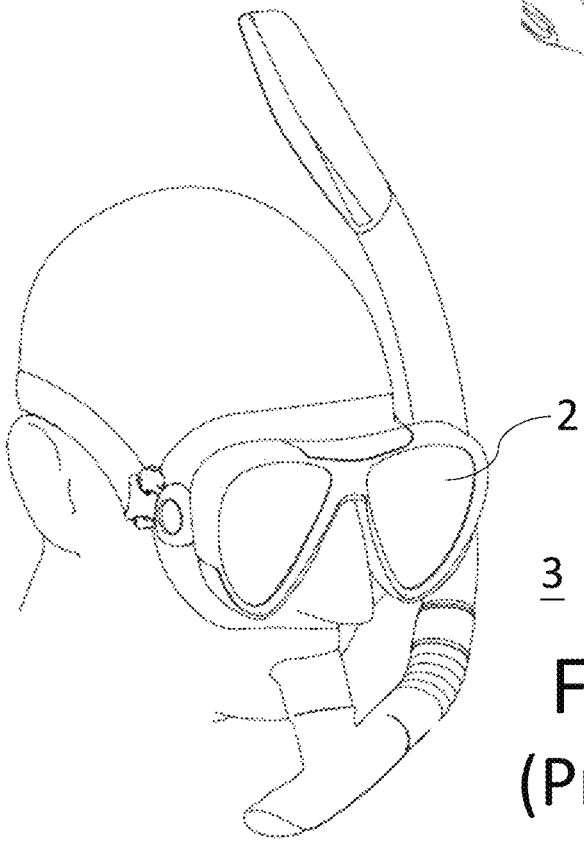
Fig. 1B (Prior art)
FIG. 1B is a schematic diagram of a user wearing a traditional snorkeling equipment.
Figure 2A:
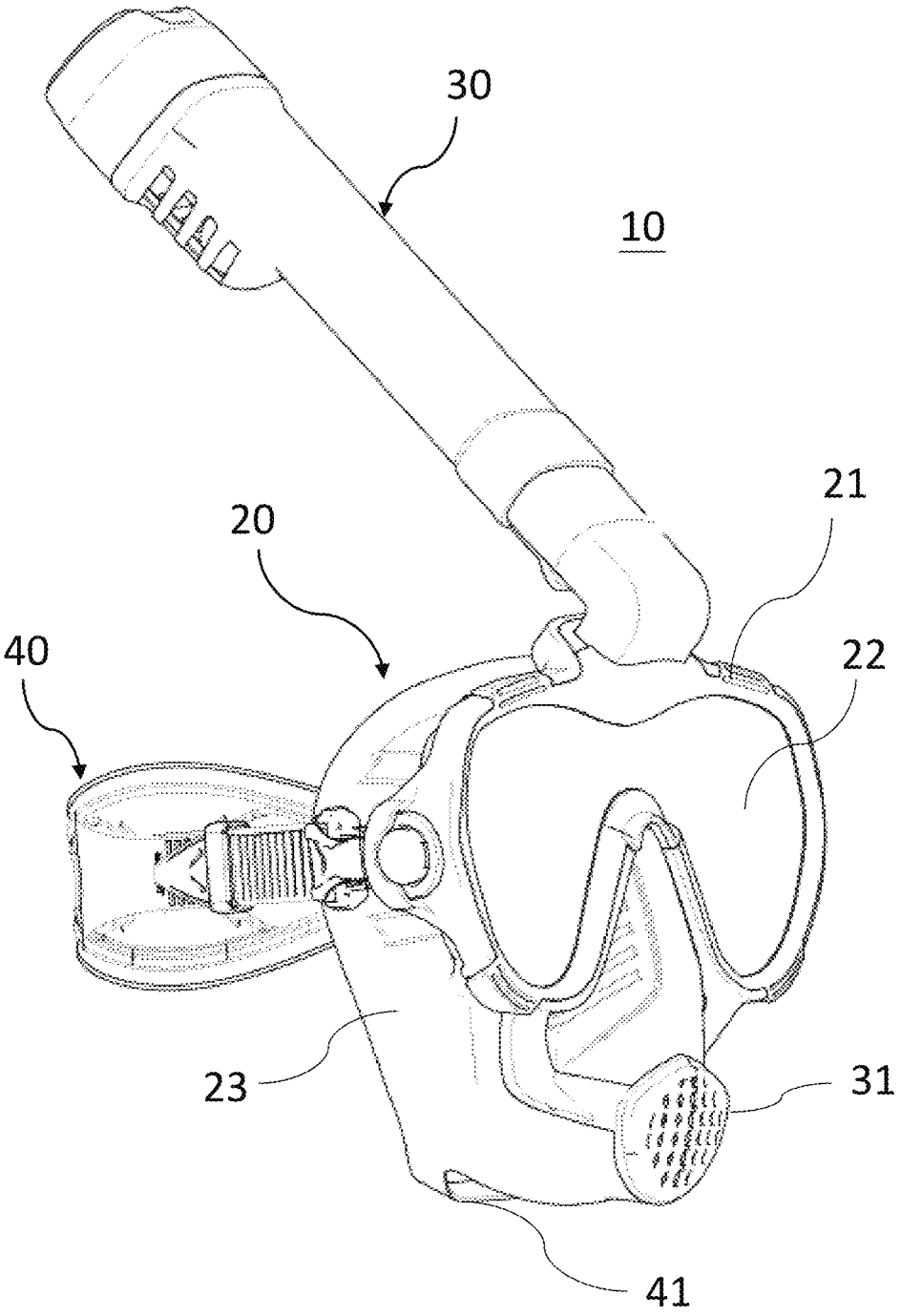
FIG. 2A is a perspective view of an embodiment of the present invention.

The technical features of the present invention mainly lie in the change of the lens structure of the mask, by adding (preferably integrally forming) onto the lens with a support which serves as a portion of the existing parts on the waterproof sealing skirt, and/or reinforces the waterproof sealing skirt with insufficient strength, thereby when the lens and the waterproof sealing skirt are assembled, the support can be interconnected with the waterproof sealing skirt, so that the rigidity of some weak portions of the waterproof sealing skirt can be increased accordingly. This technology can be applied to all masks with a hard lens or lenses, and a soft waterproof sealing skirt, including the existing "Full-face Snorkel Mask (FFSM) 1" (FIG. 1A), the mask having the lens portion 2 that covers the user's eyes, nose, and mouth, the mask used for "a diving mask 3" that only covers the eyes and nose (as shown in FIG. 1B), or other extended forms of mask. In addition, it can also be used in the "breathable mask 10" created by the inventor of this case (as shown in FIG. 2A), that is, the snorkeling mask having the lens portion only covers the user's eyes, with the nose and mouth being jointly covered by the frame and the waterproof sealing skirt. Because the structure can be used mutually, the following only takes the "breathable mask 10" as the framework, and describes various changes in sequence.

Figure 2B:
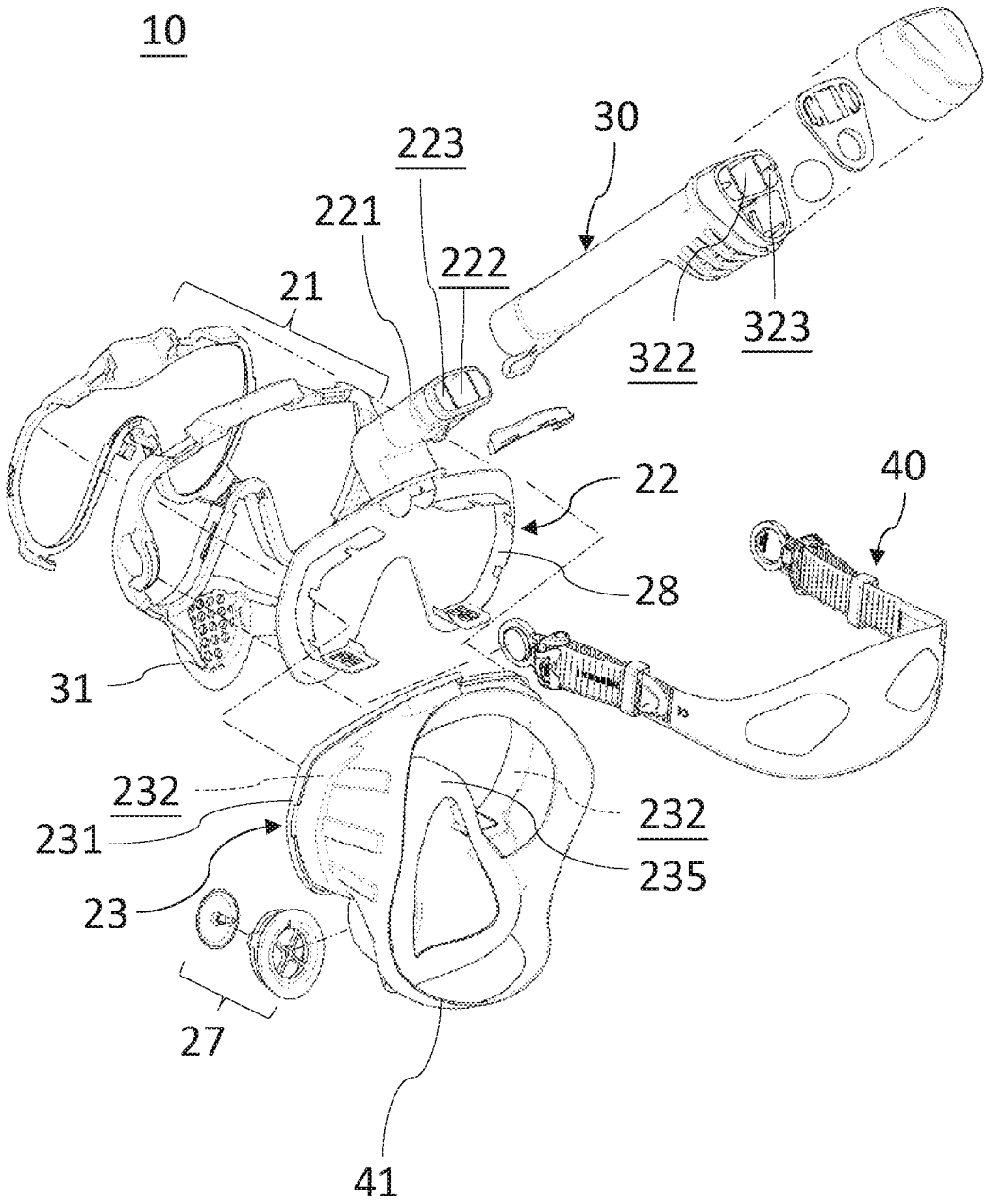
FIG. 2B is an exploded perspective view of FIG. 2A.

As shown in FIGS. 2A and 2B, a breathable mask 10 includes a body 20 and a breathing tube 30, and the breathing tube 30 is in fluid communication with an interior of the body 20. The body 20 includes a main frame 21, a lens module 22 and a waterproof sealing skirt 23. The lens module 22 is embedded in the main frame 21. The waterproof sealing skirt 23 is at least partially fitted with the main frame 21 and the lens module 22. In this embodiment, only the front eye region 231 of the waterproof sealing skirt 23 fits with the main frame 21 and the lens module 22. The rear portion of the waterproof sealing skirt 23 is suitable for fitting on the face of a user (not shown). In addition, when the user puts on the mask 10, the head strap 40 connected to the two opposite sides of the main frame 21 is suitable for tightening the user's head, whereas the chin strap 41 located under the waterproof sealing skirt 23 is suitable for tightening the user's chin, in order to establish a three-point fixation together with the two sides formed by the head strap 40.

Preferably, on a top portion of the lens module 22, a connector 221 is integrally provided. The upper end of the connector 22 is coupled with the breathing tube 30, so as to act as a bridge for airflow transmission between the breathing tube 30 and the body 20. In this embodiment, the connector 221 is divided into a central air intake conduit 222 and two side exhaust conduits 223 which are independent of the central air intake conduit 222, and the inside of the breathing conduit 30 is also divided into a mutually independent central air intake conduit 322 and exhaust conduits 323 on both sides thereof. The central air intake conduit 322 and exhaust conduits 323 at the both sides communicate with the central air intake conduit 222 and the exhaust conduits 223 at the both sides, respectively. However, it is only an embodiment that the breathing conduit 30 serves as the air intake and exhaust at the same time, and is not limited thereto. For example, the breathing tube 30 can only be responsible for the intake air, and the exhaust is arranged in other ways, which is also a suitable structure of the present invention.

Referring again to FIG. 2C, the waterproof sealing skirt 23 has a partition 235, which divides the interior of the body 20 into an upper chamber 25 and a lower chamber 26. When the user wears the breathable mask, the partition 235 is seated on the user's nose, while the user's eyes are housed in the upper chamber 25 and the user's nose, or both of nose and mouth, are housed in the lower chamber 26. In the embodiment shown in FIG. 2C, the user's nose and mouth are accommodated in the lower chamber 26 at the same time, while the lens module 22 is correspondingly located in the upper chamber 25. The drain valve 27 corresponds to be located in the lower chamber 26, and is sandwiched between the hard mouth frame 31 and the waterproof sealing skirt 23 to allow users to drain water and also have a part of exhaust function.

Figure 2C:
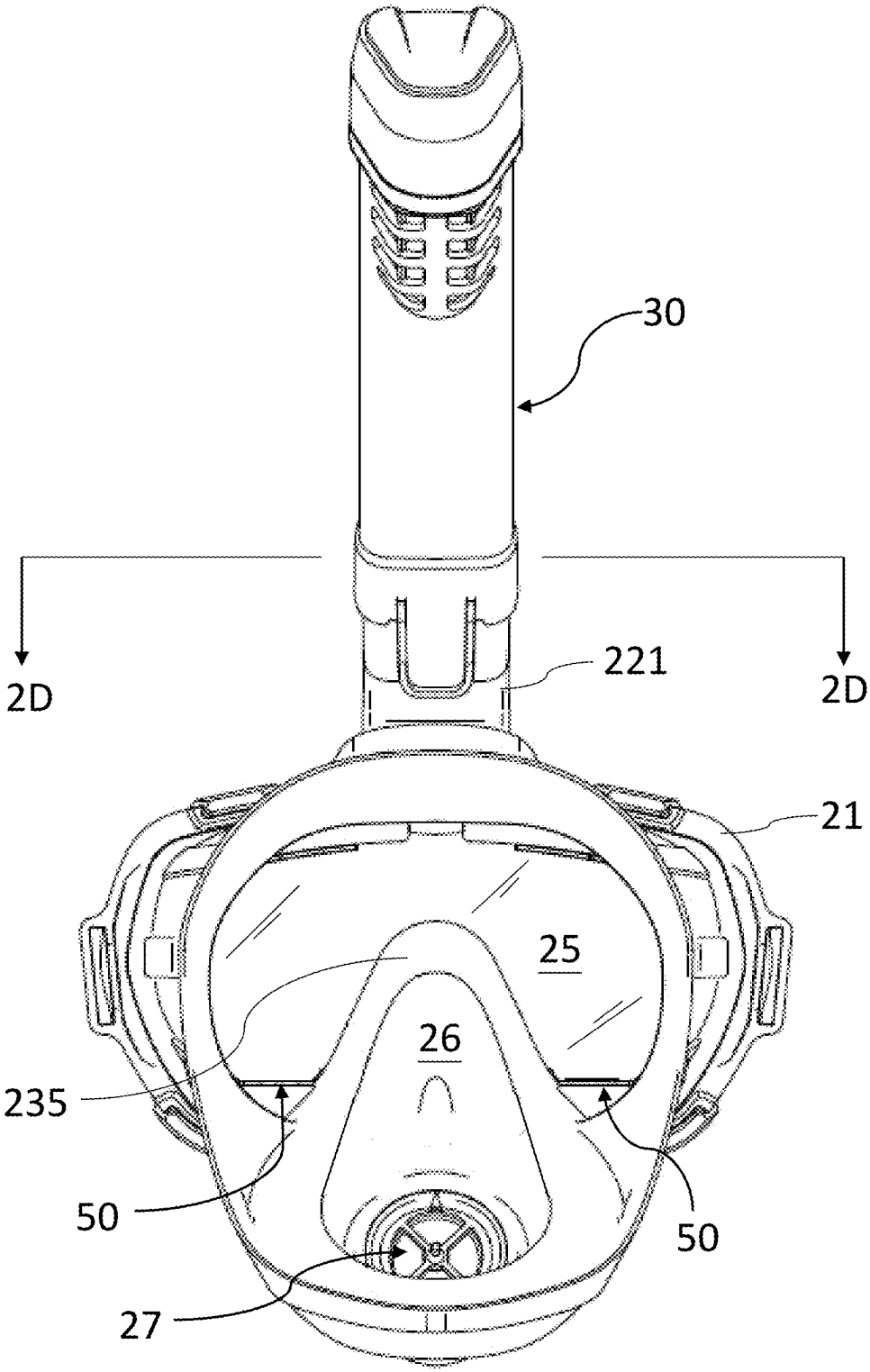
FIG. 2C is the rear view of FIG. 2A, in which the head strap is not shown.
Figure 2D:
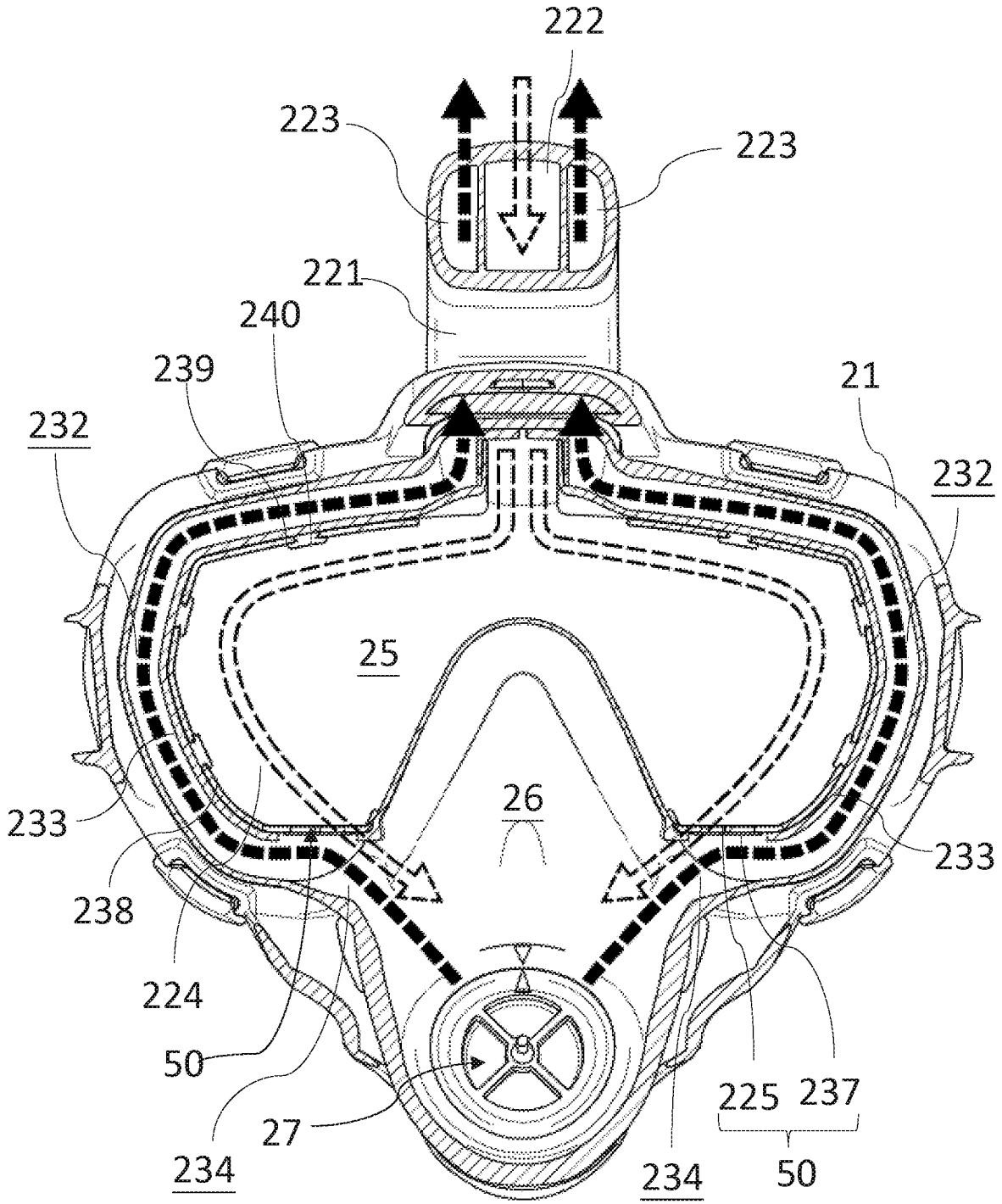
FIG. 2D is a cross-sectional view along the line 2D-2D in FIG. 2C.

Continuing to refer to FIG. 2D, in terms of air intake, there is a one-way fluid communication between the upper chamber 25 and the lower chamber 26, which only allows the fresh air in the upper chamber 25 to enter the lower chamber 26 through the one-way air intake valve 50. The dirty air exhaled in the lower chamber 26 then has no way to get back to the upper chamber 25 again. In terms of exhaust, the waterproof sealing skirt 23 is usually formed with an exhaust passage 232 extending along the outer periphery of the upper chamber 25, allowing only the dirty air in the lower chamber 26 to pass therethrough and be discharged to the outside. In other words, when the user inhales, fresh air enters the upper chamber 25 from the air intake conduit 322 of the breathing conduit 30 through the air intake conduit 222 of the connector 221, and after cleaning the possible fogging of the lens module 22, it enters the lower chamber 26 through the one-way intake valve 50 in order for the user's inhalation, as shown by the hollow dashed line in FIG. 2D. When the user exhales through the mouth or nose, the dirty air is discharged to the outside along the exhaust passage 232, through the exhaust conduit 223 of the connector 221 and the exhaust conduit 323 of the breathing tube 30, as shown by the solid dashed line in FIG. 2D. Therefore, a mechanism of intake and exhaust shunt flow is formed accordingly.

Since the lens module 22 needs to be assembled with the waterproof sealing skirt 23 anyway, the present invention conceives that the lens module 22 is additionally installed or integrally formed with some reinforcement components to support the soft waterproof sealing skirt 23. It not only simplifies the number of parts and reduces the cost, but also saves a lot of assembly costs. Therefore, the technical characteristics of the present invention are created. Specifically, the lens module 22 provides a lens portion 224 and a support device, and the support device is integrally formed with the lens portion 224 at a distance inward from the outermost edges of the lens portion 224, and is connected to a portion of the waterproof sealing skirt portion 23 so as to increase rigidity of a vicinity of the portion the waterproof sealing skirt 23. Preferably, the support device may include, but is not limited to, the valve seat of the one-way intake valve on the waterproof sealing skirt 23, the reinforcing ribs on both sides of the one-way intake valve, and/or the retaining wall for abutting against the exhaust passage, which will be described in sequence below.

Figure 2E:
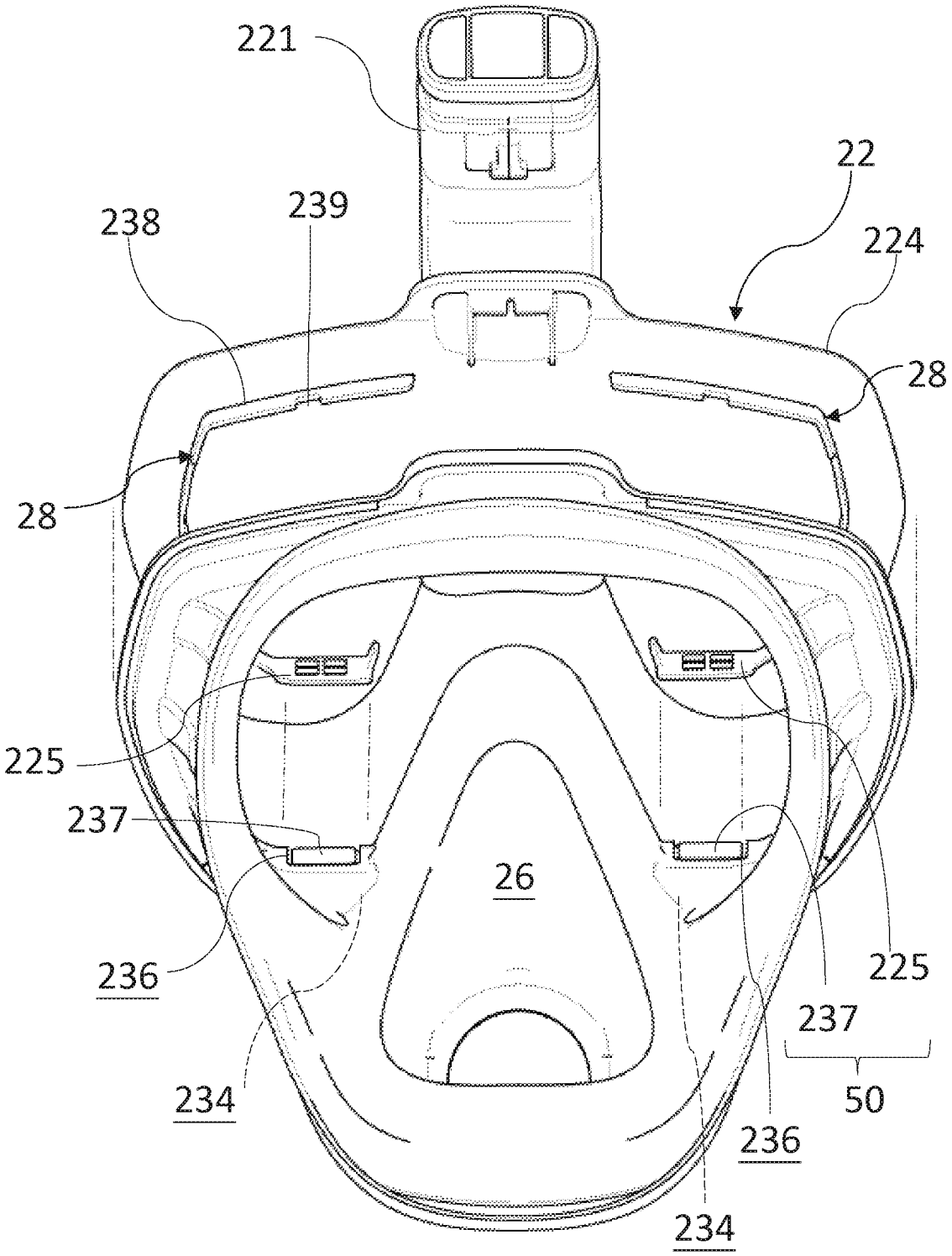
FIG. 2E is a perspective exploded view showing the lens module and waterproof sealing skirt of FIG. 2A.

As shown in FIGS. 2C, 2D and 2E, the one-way intake valve 50 is a pivoting one-way valve. The support device 28 has a valve seat 225, and the exhaust passage 232 has an entrance 234 and an inner sidewall 233, in which near the entrance 234, the inner sidewall 233 is provided with an air inlet 236 and a swing-type diaphragm 237 covering the air inlet 236, whereby this pivoting one-way valve is formed by the valve seat 225 and the swing-type diaphragm 237 which are separately arranged at two opposing sides of this air inlet 236, in order for fresh air entering therethrough from the upper chamber 25 to the lower chamber 26. Most preferably, the pivoting of the swing-type diaphragm 237 is set to be the side proximal to the partition 235 to ensure that the one-way intake valve 50 can be closed when the user exhales, and is integrally formed on the inner sidewall 233 near the entrance 234 of the exhaust passage, whereas the valve seat 225 is integrally formed on the lens portion 224. FIG. 2E reveals a clear structural relationship as mentioned above.

Further as shown in FIGS. 2B, 2D and 2E, the support device 28 further includes a retaining wall 238, and the exhaust passage 232 is located between the main frame 21 and the retaining wall 238. The retaining wall 238 is shaped to at least partially abut against the inner sidewall 233 of the exhaust passage 232. More preferably, the retaining wall 238 includes a plurality of female buckles 239, and the outer side of the inner sidewall 233 of the exhaust passage 232 is provided with a plurality of male buckles 240, which are suitable for respectively fastening with the plurality of female buckles 239, so that the retaining wall 238 and the exhaust passage 232 cannot be separated from each other.

Figure 3A:
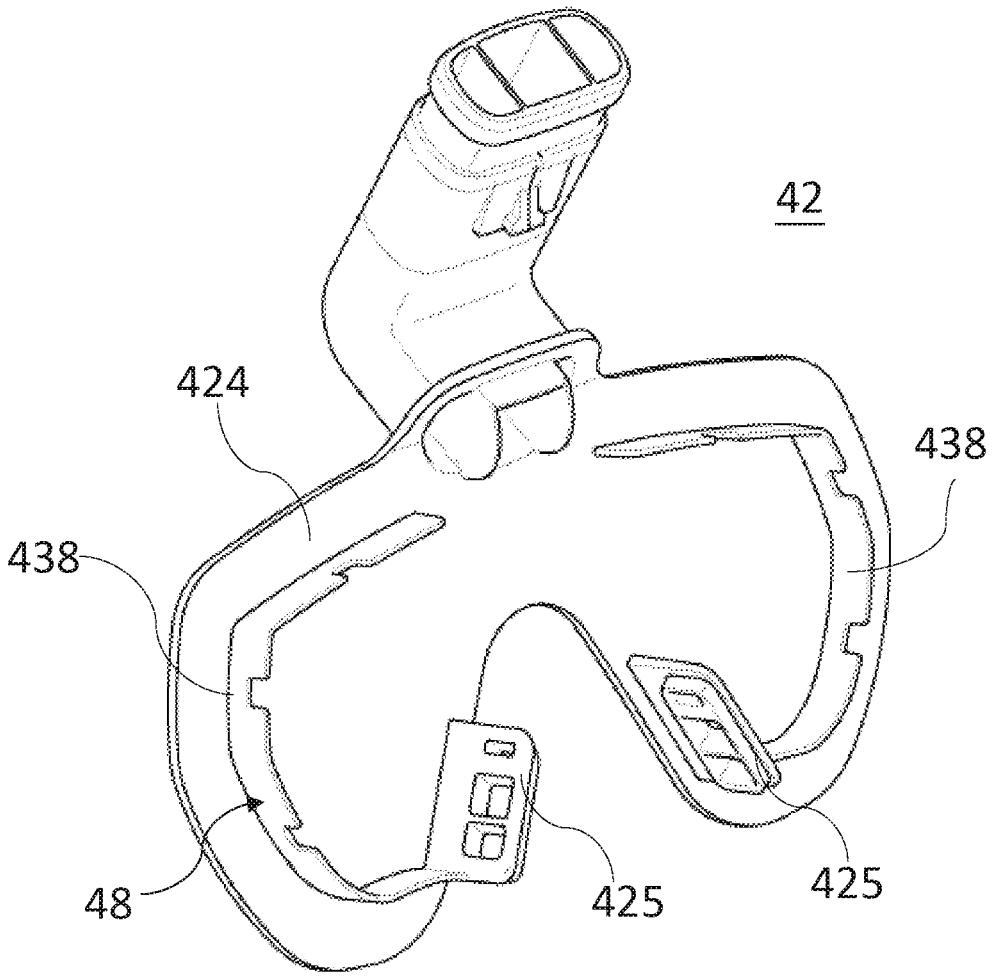
FIG. 3A is a perspective view of a lens module according to another embodiment of the present invention.
Figure 3B:
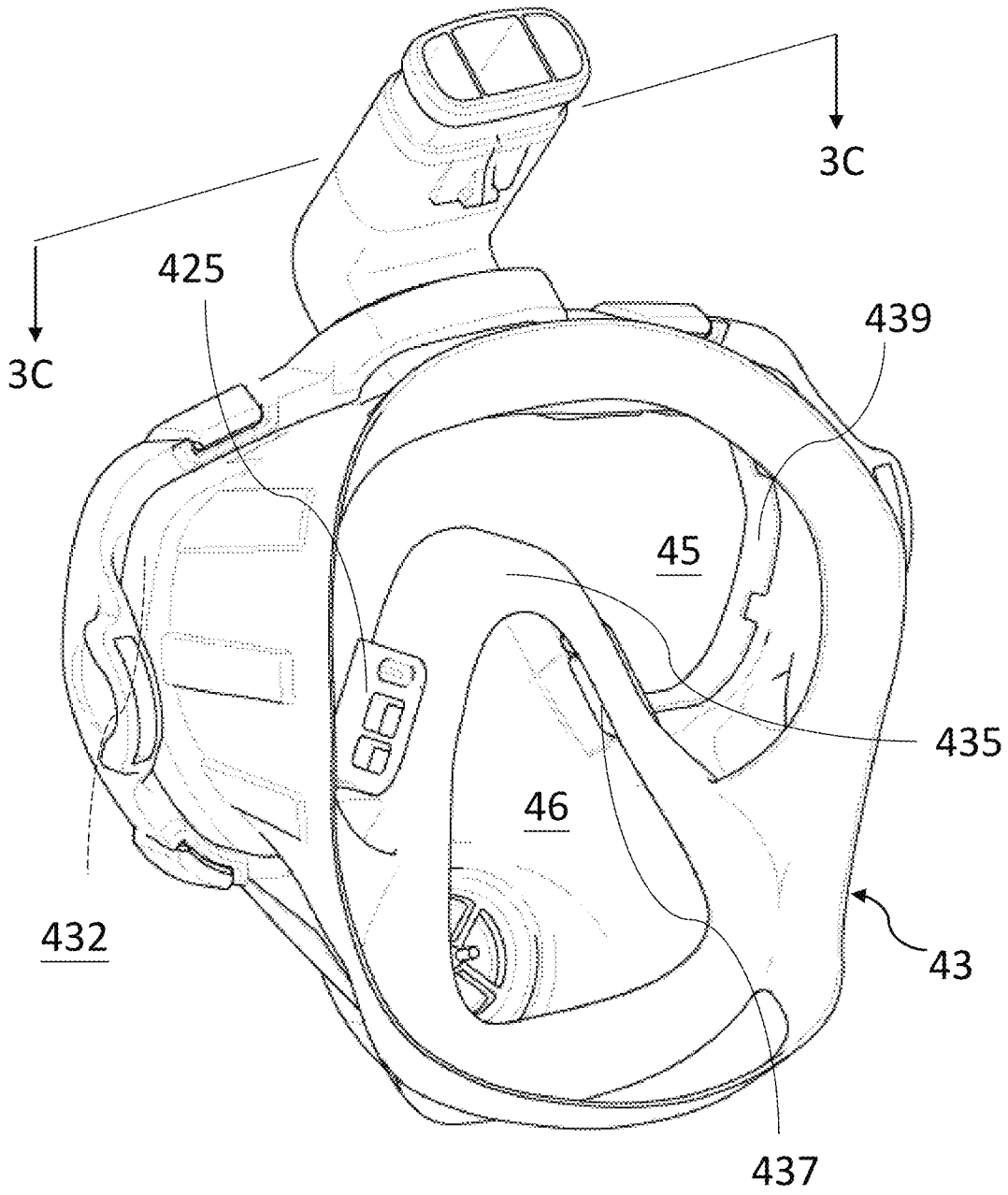
FIG. 3B is a perspective view of the embodiment corresponding to FIG. 3A, in which the head strap and breathing tube are not shown.
Figure 3C:
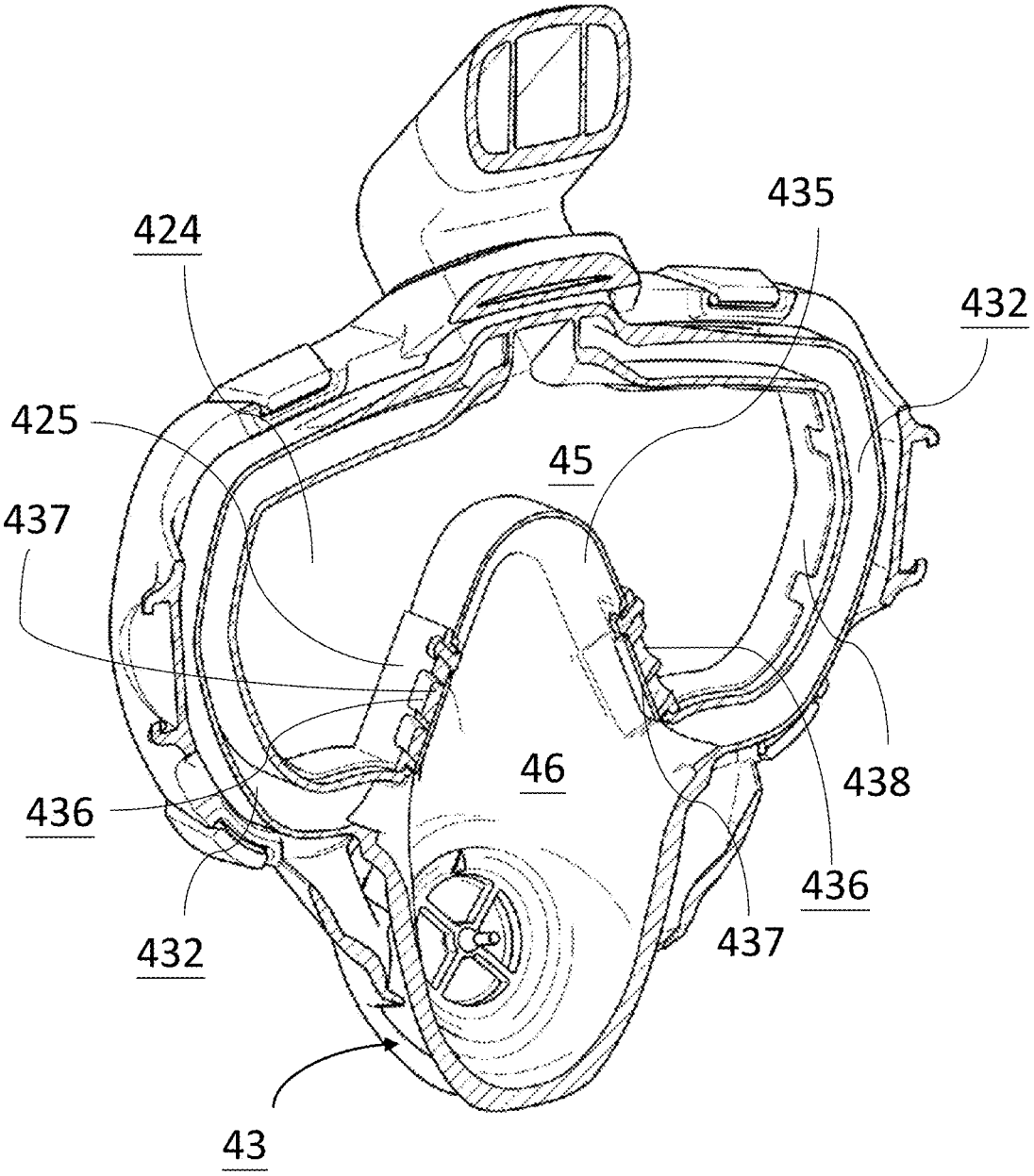
FIG. 3C is a cross-sectional view along the line 3C-3C in FIG. 3B.

FIGS. 3A, 3B and 3C show another embodiment which also comes with a pivoting one-way valve. The lens module 42 has a lens portion 424 and a support device 48, and the support device 48 is integrally formed with the lens portion 424. The difference in this embodiment only resides in that the pivoting one-way valve for communicating the upper chamber 45 with the lower chamber 46 is changed to be installed on the partition 435. The other arrangements are the same as those in the previous embodiment and will not be repetitively described herein. In this embodiment, the support device 48 has a valve seat 425. On the partition 435, the waterproof sealing skirt 43 is provided with an air inlet 436 and a swing-type diaphragm 437 covering the air inlet 436. The pivoting one-way valve is formed by the valve seat 425 and the swing-type diaphragm 437 which are respectively arranged on two sides of the air inlet 436. Similarly, the support device can additionally have a retaining wall 438 for leaning on or fixing the exhaust passage 432. In this embodiment, the swing-type diaphragm 437 is a component separate from, not integrally formed with, the partition 435.

Figure 4A:
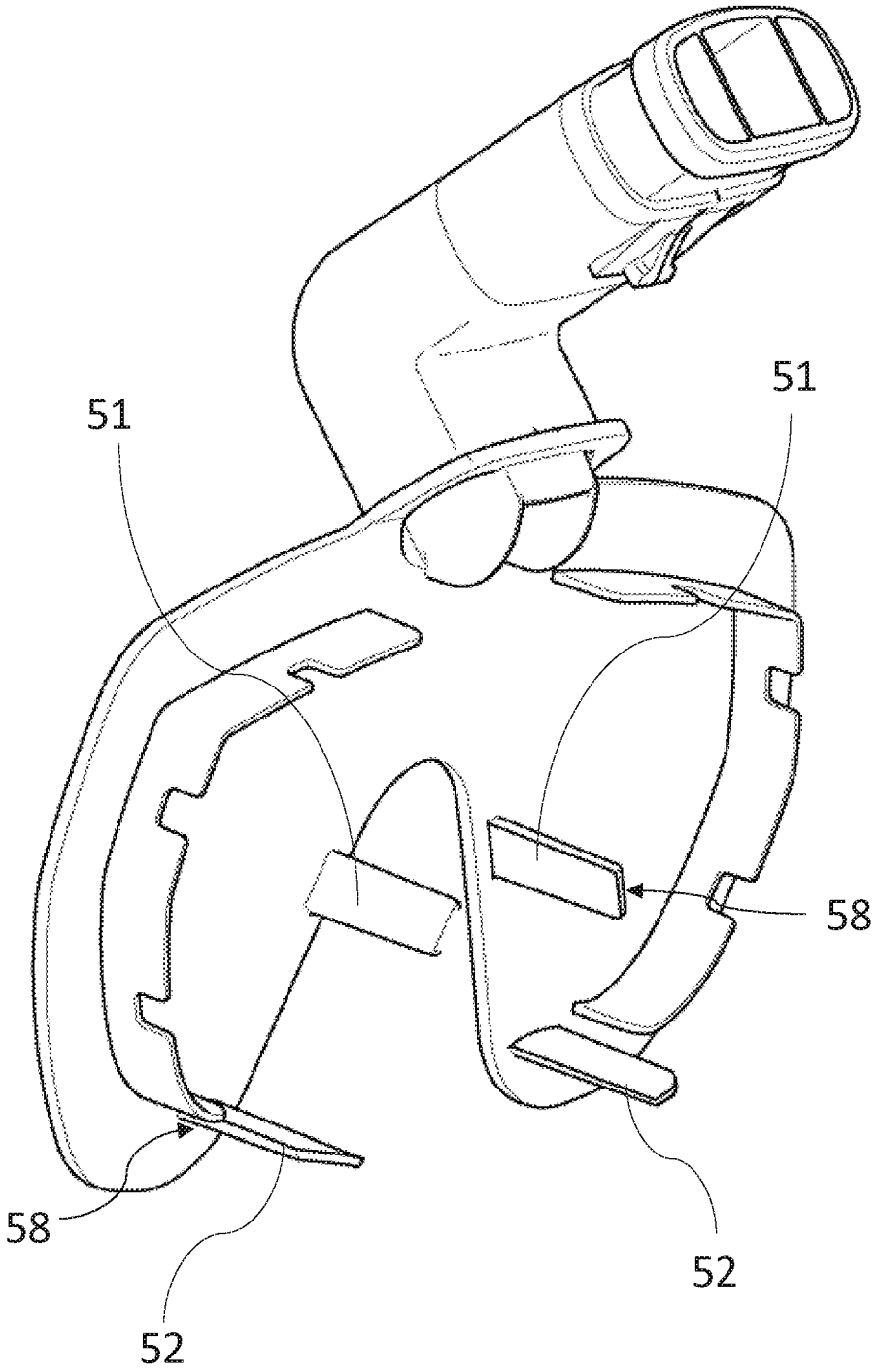
FIG. 4A is a perspective view of a lens module according to yet a further embodiment of the present invention.
Figure 4B:
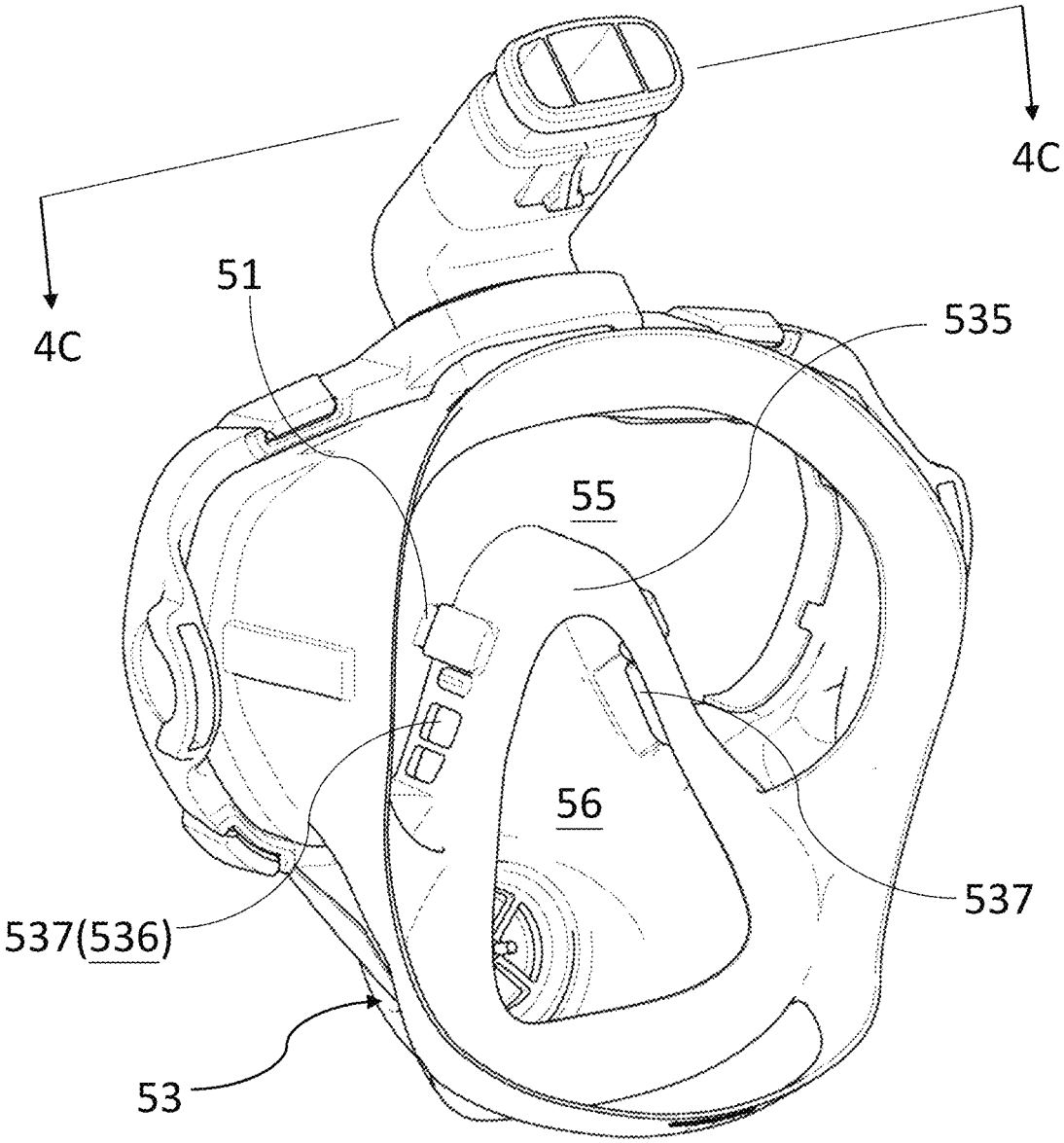
FIG. 4B is a perspective view of the embodiment corresponding to FIG. 4A, in which the head strap and breathing tube are not shown.
Figure 4C:
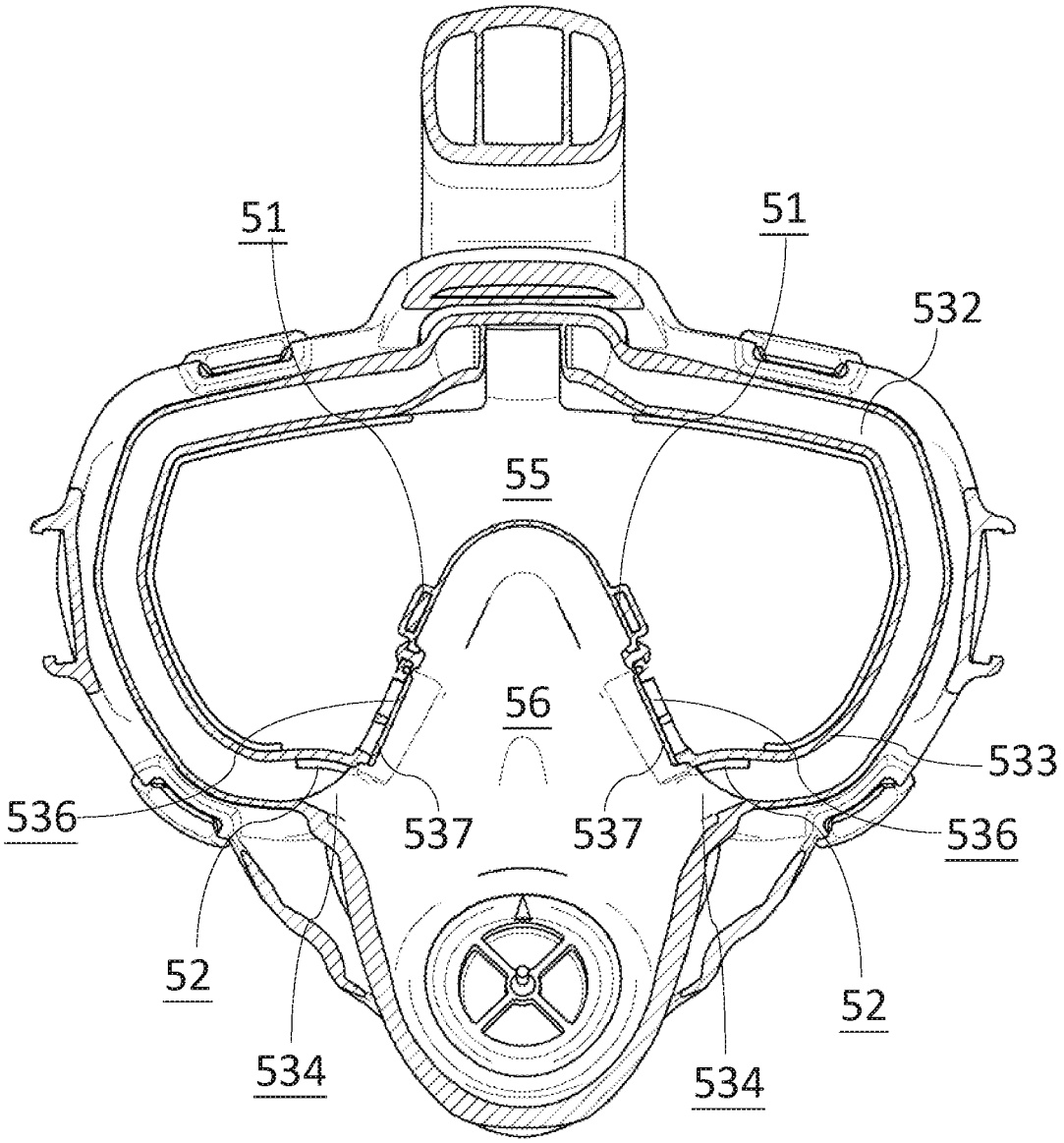
FIG. 4C is a cross-sectional view along the line 4C-4C in FIG. 4B.
Figure 5A:
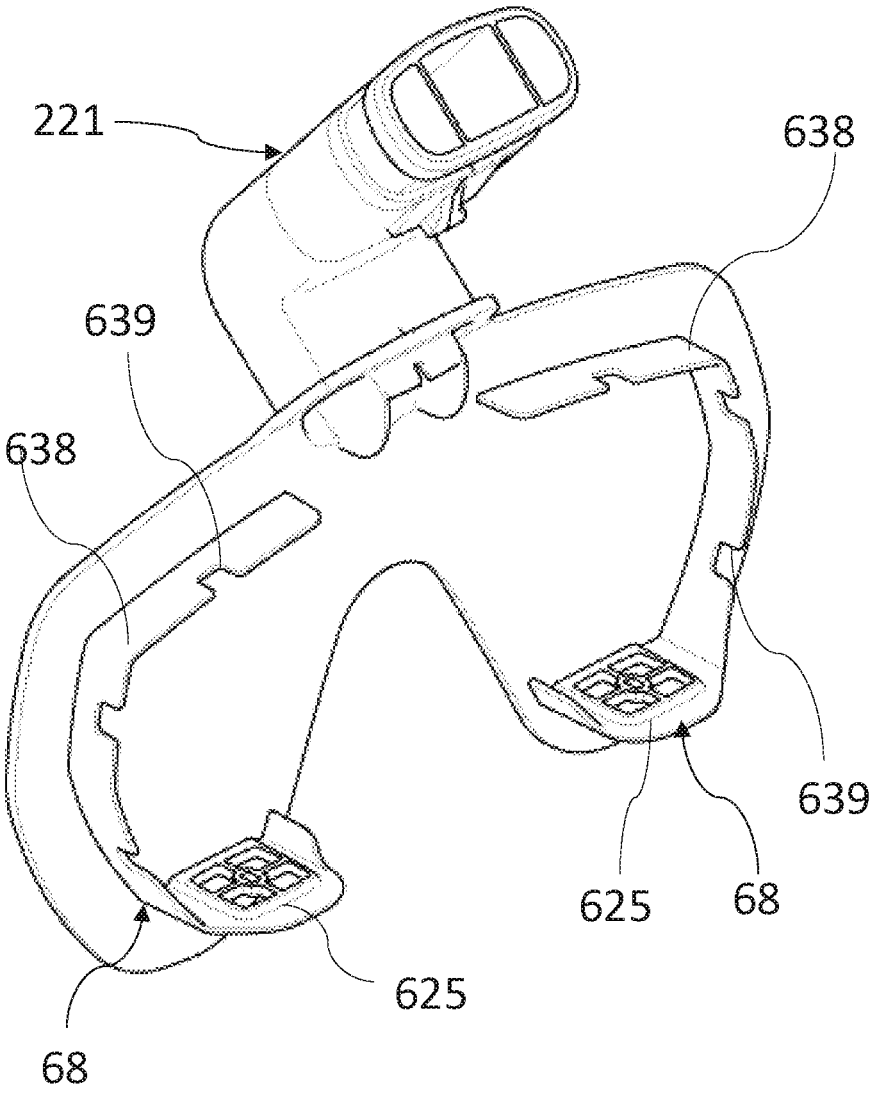
FIG. 5A is a perspective view of a lens module according to yet another embodiment of the present invention.
Figure 5B:
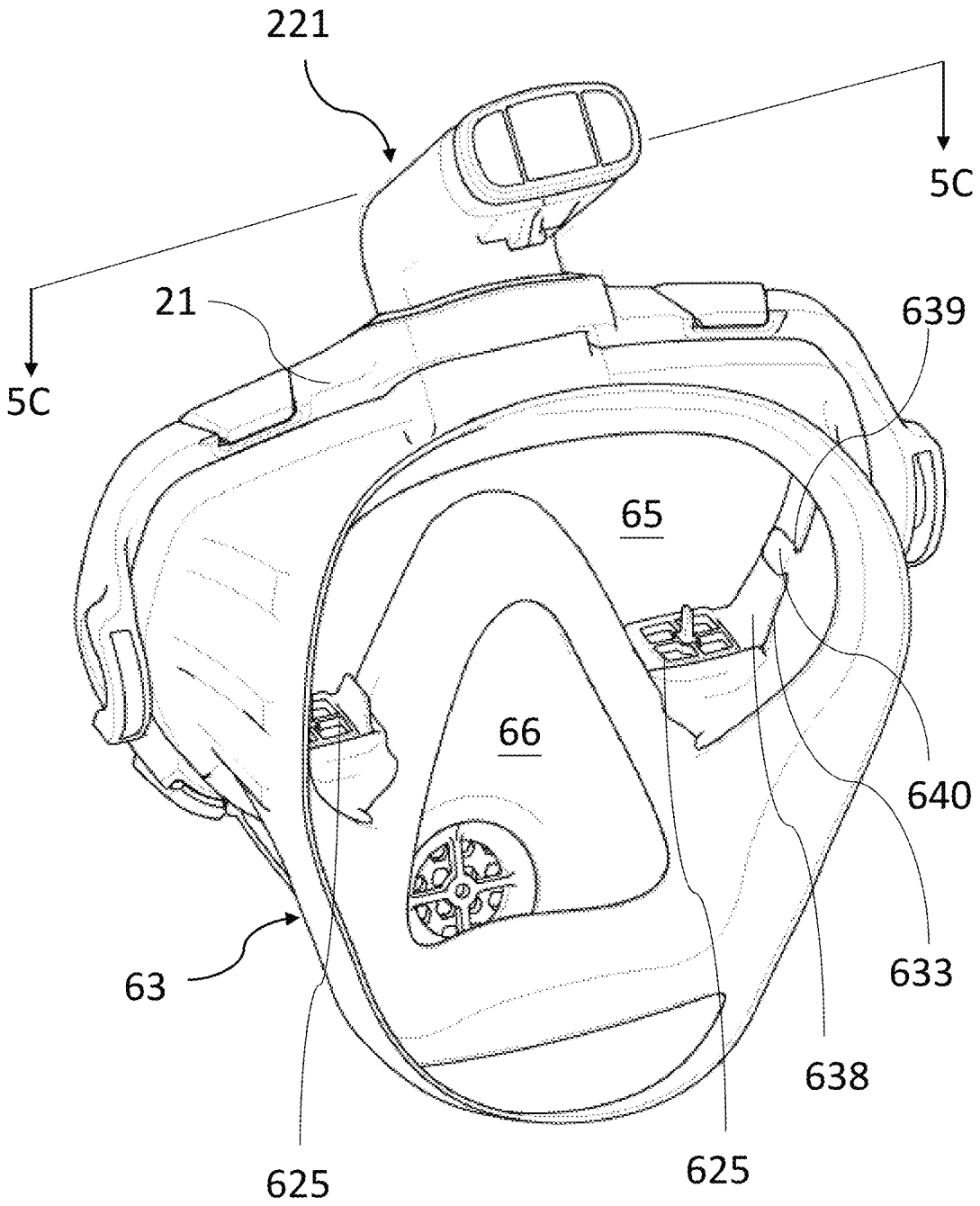
FIG. 5B is a perspective view of the embodiment corresponding to FIG. 5A, in which the head strap and breathing tube are not shown.
Figure 5C:
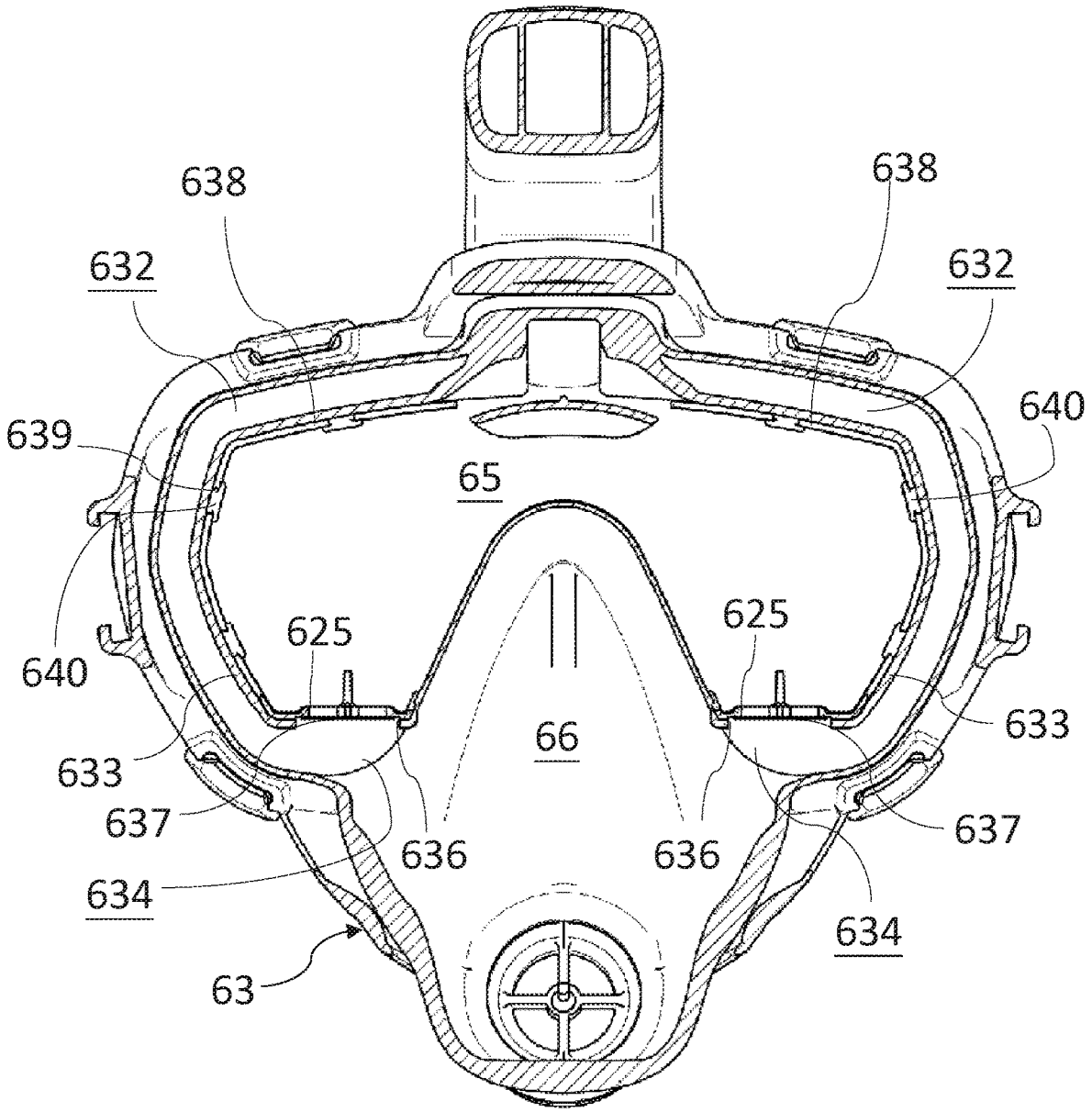
FIG. 5C is a cross-sectional view along the line 5C-5C in FIG. 5B.

FIGS. 4A, 4B and 4C show yet another embodiment of this invention. Although the pivoting one-way valve is also arranged, the support device 58 is not necessarily a valve seat of the one-way valve, but a reinforcing rib or ribs supporting the one-way valve. In detail, the waterproof sealing skirt 53 is provided with an air inlet 536 formed on the partition 535, and a swing-type diaphragm 537 covering the air inlet 536. The pivoting one-way valve is formed by the air inlet 536 together with the swing-type diaphragm 537 which is arranged on an inner side of the air inlet 536. The waterproof sealing skirt 53 is formed with an exhaust passage 532 extending along the outer periphery of the upper chamber 55, only allowing the lower chamber 56 to be in fluid communication with the outside through the exhaust passage 532 in order for the discharge of the air exhaled by the user. Similarly, the exhaust passage 532 has an entrance 534 and an inner sidewall 533, whereas the support device 58 has a first rib 51 and a second rib 52, in which the first rib 51 and the waterproof sealing skirt 53 are embedded together above the pivoting one-way valve, whereas the second rib 52 and the waterproof sealing skirt 53 are embedded in the inner sidewall 533 near the entrance 534 of the exhaust passage 532, so as to strengthen the waterproof sealing skirt 53 on which the pivoting one-way valve is located and prevent the structure from being collapsed.

Similar to the embodiment of FIGS. 2A to 2E, FIGS. 5A, 5B and 5C are yet another embodiment of the present invention, wherein the intake one-way valve does not adopt a pivoting one-way valve, but adopts a mushroom type one-way valve. Similarly, however, the support device 68 is also pre-installed with an integrally formed valve seat, in order to facilitate and stabilize the assembly with the waterproof sealing skirt. Specifically, in this embodiment, the one-way air intake valve is selected a mushroom-type one-way valve. The waterproof sealing skirt 63 is formed with an exhaust passage 632 extending along the outer periphery of the upper chamber 65, only allowing the lower the chamber 66 to be in fluid communication with the outside therethrough for the discharge of the air exhaled by the user. The support device 68 has a valve seat 625, and the exhaust passage 632 has an entrance 634 and an inner sidewall 633, which is provided with an air inlet 636 close to the entrance 634. The mushroom-type one-way valve is formed by the valve seat 625 which is installed on the air inlet 636, and is fixed with a diaphragm 637 at a lower, central portion thereof to cover the air inlet 636, thereby only allowing fresh air to flow from the upper chamber 65 to the lower chamber 66. Same as the embodiment shown in FIG. 2A through FIG. 2E, in this embodiment, the support device 68 further includes a retaining wall 638, and the exhaust passage 634 is located between the main frame 21 and the retaining wall 638. The retaining wall 638 is at least partially continuous, and is at least partially disposed to abutting against the inner sidewall 633 of the exhaust passage 634. Preferably, the retaining wall 638 includes a plurality of female buckles 639, and the outer side of the inner sidewall 633 of the exhaust passage 634 is provided with a plurality of male buckles 640, which are suitable for respectively fastening with the plurality of female buckles 639, so that the retaining wall 638 and the inner sidewall 633 of the exhaust passage 634 will not be separated from each other.

Except that the above-mentioned preferred embodiments have been described in detail for the structure and action of the technology of the present invention, any style based on the concept of the present invention, for example, the intake one-way valve shaped pivoted, mushroom-shaped or other forms, the location and number of intake one-way valves, the type of retaining wall and its connection method with the exhaust passage, etc., should not be limited, and should still belong to the equivalents of the present invention. That is, any equivalents should not be literally limited by the claims of this application set forth in the following paragraph.

DESCRIPTION OF REFERENCE NUMERALS IN THE DRAWINGS

1 full face snorkel mask
2 lens portion
3 diving masks
10 breathable mask
20 body
21 main frame
22 lens module
28 support device
221 connector
222 intake conduit
223 exhaust conduit
224 lens portion
225 valve seat
23 waterproof sealing skirt
231 front eye region
232 exhaust passage
233 inner sidewall
234 entrance
235 partition
236 air inlet
237 swing-type diaphragm
238 retaining wall
239 female buckle
240 male buckle
25 upper chamber
26 lower chamber
27 drain valve
30 breathing tube
31 mouth frame
322 intake conduit
323 exhaust conduit
40 head strap
41 chin strap
42 lens module
424 lens portion
425 valve seat
43 waterproof sealing skirt
432 exhaust passage
435 partition
436 air inlet
437 swing-type diaphragm
438 retaining wall
45 upper chamber
46 lower chamber
48 support device
50 one-way intake valve
51 first rib
52 second rib
53 waterproof sealing skirt
55 upper chamber
56 lower chamber
58 support device
532 exhaust passage
533 inner sidewall
534 entrance
535 partition
536 air inlet
537 swing-type diaphragm
625 valve seat
63 waterproof sealing skirt
632 exhaust passage
633 inner sidewall
634 entrance
636 air inlet
637 diaphragm
638 retaining wall
639 female buckle
640 male buckle
65 upper chamber
66 lower chamber
68 support device

The invention claimed is:

1. A breathable mask, comprising a body and a breathing tube, in which the breathing tube is in fluid communication with an interior of the body; the body including:

a main frame;

a lens module fitted in the main frame;

a waterproof sealing skirt, at least partially fitted with the main frame and the lens module, the waterproof sealing skirt being suitable for fitting on a user's face;

wherein the waterproof sealing skirt has a partition to separate the interior of the body into an upper chamber and a lower chamber, when the user puts on the breathable mask, the partition is seated on the user's nose, the user's eyes are housed in the upper chamber, and the user's nose is, or both of the user's nose and mouth are, housed in the lower chamber;

wherein a one-way fluid communication is formed between the upper chamber and the lower chamber, and only air in the upper chamber is allowed to enter the lower chamber through a one-way air intake valve;

wherein the waterproof sealing skirt forms an exhaust passage extending along an outer periphery of the upper chamber, only allowing the lower chamber to be in fluid communication with an outside through the exhaust passage for air exhaled by the user to be discharged;

wherein the lens module has a lens portion and a support device, the support device is integrally formed with the lens portion at a distance inward from an outermost edge of the lens portion, and is connected to a portion of the waterproof sealing skirt, so as to increase rigidity of a vicinity of the portion the waterproof sealing skirt, and the support device includes at least one of a valve seat of the one-way intake valve, a retaining wall for abutting against the exhaust passage, and a plurality of reinforcing ribs on both sides of the one-way intake valve.

2. The breathable mask according to claim 1, wherein the lens modules is correspondingly located in the upper chamber.

3. The breathable mask according to claim 1, wherein the one-way air intake valve is a pivoting one-way valve; and wherein when the support device has the valve seat, and the exhaust passage has an entrance and an inner sidewall, in which the inner sidewall is provided with an air inlet and a swing-type diaphragm covering the air inlet near the entrance of the exhaust passage, and the pivoting one-way valve is thereby formed by the valve seat and the diaphragm which are separately arranged at two opposing sides of the air inlet.

4. The breathable mask according to claim 2, wherein, when the support device further includes a retaining wall, and the exhaust passage is located between the main frame and the retaining wall; and wherein the retaining wall at least partially abuts against the inner sidewall of the exhaust passage.

5. The breathable mask according to claim 4, wherein the retaining wall includes a plurality of female buckles, and an outer side of the inner sidewall of the exhaust passage is provided with a plurality of male buckles, which are suitable for respectively connecting with the plurality of female buckles, thereby the retaining wall and the exhaust passage are not separated from each other.

6. The breathable mask according to claim 2, wherein the breathing tube has an air intake conduit and an exhaust conduit independently arranged with the air intake conduit, and the exhaust passage runs along the outer periphery of the upper chamber and communicates with the exhaust conduit of the breathing tube, so as to allow the lower chamber to be in fluid communication with the outside through the exhaust passage and the exhaust conduit.

7. The breathable mask according to claim 1, wherein the one-way air intake valve is a pivoting one-way valve; wherein, when the support device has the valve seat, and the partition of the waterproof sealing skirt is provided with an air inlet and a swing-type diaphragm covering the air inlet; and wherein the pivoting one-way valve is thereby formed by the valve seat and the swing-type diaphragm which are respectively arranged on two opposing sides of the air inlet.

8. The breathable mask according to claim 7, wherein, when the support device further includes the retaining wall, and the exhaust passage is located between the main frame and the retaining wall; and wherein the retaining wall is at least partially continuous, and at least partially abutting against the inner sidewall of the exhaust passage.

9. The lens module according to claim 8, wherein when the user wears the breathable mask, the lens module correspondingly shields the eyes of the user.

10. The lens module according to claim 8, wherein when the user wears the breathable mask, the lens module correspondingly covers the user's eyes, nose and mouth.

11. The breathable mask according to claim 1, wherein the one-way air inlet valve is a pivoting one-way valve; wherein the partition of the waterproof sealing skirt is provided with an air inlet and a swing-type diaphragm covering the air inlet, in which the swing-type diaphragm is arranged on an inner side of the air inlet, so as to form the pivoting one-way valve; wherein the waterproof sealing skirt is further formed with an exhaust passage, which extends along an outer periphery of the upper chamber, and only allows the lower chamber to be in fluid communication with an outside through the exhaust passage for air exhaled by the user to be discharged; and wherein the exhaust passage has an entrance and an inner sidewall, in which the support device has a first rib and a second rib, in which the first rib and the waterproof sealing skirt are embedded together above the pivoting one-way valve, whereas the second rib and the waterproof sealing skirt are embedded in the inner sidewall near the entrance of the exhaust passage, so as to strengthen the waterproof sealing skirt on which the pivoting one-way valve is located.

12. The breathable mask according to claim 11, wherein the retaining wall includes a plurality of female buckles, and an outer side of the inner sidewall of the exhaust passage is provided with a plurality of male buckles, which are suitable for respectively connecting with the plurality of female buckles, thereby the retaining wall and the exhaust passage are not separated from each other.

13. The breathable mask according to claim 1, wherein the one-way air intake valve is a mushroom-type one-way valve; wherein the waterproof sealing skirt is further formed with an exhaust passage, which extends along an outer periphery of the upper chamber, and only allows the lower chamber to be in fluid communication with an outside through the exhaust passage for air exhaled by the user to be discharged; wherein, when the support device has the valve seat, and the exhaust passage has an entrance and an inner sidewall which is provided with an air inlet close to the entrance of the exhaust passage, and wherein the mushroom-type one-way valve is formed by the valve seat which is installed on the air inlet, and is fixed with a diaphragm at a lower, central portion thereof to cover the air inlet.

14. An integrally formed lens module, which is used on the breathable mask according to claim 1.

* * * * *